US005905006A

United States Patent [19]

Tavernier et al.

[11] Patent Number: 5,905,006

[45] Date of Patent: May 18, 1999

[54] TONER IMAGE RESISTANT TO CRACKING

[75] Inventors: Serge Tavernier, Lint; Stefaan De Meutter, Antwerpen, both of Belgium

[73] Assignee: AGFA-Gevaert, N.V., Mortsel, Belgium

[21] Appl. No.: 08/886,414

[22] Filed: Jul. 1, 1997

Related U.S. Application Data

[ 60] Provisional application No. 60/026,779, Sep. 20, 1996.

[30] Foreign Application Priority Data

Jul. 1, 1996 [EP] European Pat. Off. ..... 96201826

[51] Int. Cl.[6] ..... G03G 15/01

[52] U.S. Cl. ..... 430/14; 399/340

[58] Field of Search ..... 430/14, 124; 399/340

[56] References Cited

U.S. PATENT DOCUMENTS

| | | | |
|---|---|---|---|
| 4,064,285 | 12/1977 | Mammino | 430/124 |
| 5,339,146 | 8/1994 | Aslam et al. | 430/124 |
| 5,681,660 | 10/1997 | Bull et al. | 428/500 |

FOREIGN PATENT DOCUMENTS

| | | |
|---|---|---|
| 0 081 887 | 6/1983 | European Pat. Off. . |
| 0 486 235 | 5/1992 | European Pat. Off. . |
| 60-135974 | 7/1985 | Japan . |
| 1272008 | 4/1972 | United Kingdom . |

OTHER PUBLICATIONS

Xerox Disclosure Journal, vol. 16, No. 5, Sep./Oct. 1991, Stamford, CT, p. 333; Rabin Moser, "Method To Improve Color Copy and Transparency Quality".

Encyclopedia of Polymer Science and Technology, H. F. Mark et al, vol. 10, 1969; John Wiley & Sons, Inc., New York; pp. 247–249.

*Primary Examiner*—John Goodrow

*Attorney, Agent, or Firm*—Breiner & Breiner

[57] ABSTRACT

A toner image, comprising a plurality of fused different types of toner particles on a substrate is provided wherein on top of the image, optionally comprising a clear finish layer, a plasticizer is present in an amount between 0.1 and 10 $g/m^2$. At least one of the different types of toner particles contains a toner resin with at least one reactive group A and the plasticizer carries at least one reactive group B and when the plasticizer is applied to the toner image, the reactive group A reacts with reactive group B and forms a chemical bond between the toner image and the plasticizer. A method and an apparatus for providing such a toner image, resistant to cracking are also provided.

5 Claims, No Drawings

TONER IMAGE RESISTANT TO CRACKING

This application claims the benefit of U.S. Provisional Application Ser. No. 60/026,779 filed Sep. 20, 1996.

DESCRIPTION

1. Field of the Invention

This invention relates to an electrostatographic imaging method. In particular this invention relates to a method to improve the mechanical properties of fixed toner images comprising several superimposed toner layers.

2. Background of the Invention

Electrostatic printing methods are manifold, e.g. Direct Electrostatic Printing, wherein electrostatic printing is performed directly from a toner delivery means on a receiving substrate, the latter not bearing any imagewise latent electrostatic image, by means of an electronically addressable printhead structure.

In another form of electrostatic printing toner images are made on an image-forming element in the form of a rotating drum provided with an electrostatic layer built up from a number of controllable electrodes in and beneath a dielectric layer. The voltage that is image-wise applied to said controllable electrodes attracts charged toner particles from a toner source.

It is also well known in the art of electrographic printing and electrophotographic copying to form an electrostatic latent image corresponding to either the original to be copied, or corresponding to digitized data describing an electronically available image.

In electrophotography an electrostatic latent image is formed by the steps of uniformly charging a photoconductive member and imagewise discharging it by an imagewise modulated photo-exposure.

In electrography an electrostatic latent image is formed by imagewise depositing electrically charged particles, e.g. from electron beam or ionized gas onto a dielectric substrate.

The obtained latent images are developed, i.e. converted into visible images by selectively depositing thereon light absorbing particles, called toner particles, which usually are triboelectrically charged.

In magnetography a latent magnetic image is formed in a magnetizable substrate by a pattern wise modulated magnetic field. The magnetizable substrate must accept and hold the magnetic field pattern required for toner development which proceeds with magnetically attractable toner particles.

In toner development of latent electrostatic images two techniques have been applied: "dry" powder and "liquid" dispersion development of which dry powder development is nowadays most frequently used.

In dry development the application of dry toner powder to the substrate carrying the latent electrostatic image may be carried out by different methods known as, "cascade", "magnetic brush", "powder cloud", "impression" or "transfer" development also known as "touchdown" development described e.g. by Thomas L. Thourson in IEEE Transactions on Electronic Devices, Vol. ED-19, No. 4, April 1972, pp.495–511.

In the case of direct printing technologies, the toning developer is directly, image wise deposited on a final substrate to form a visible image. In the case of indirect printing methods a latent image, electrostatic or magnetographic, is developed to form a visible image. This visible image is then transferred, either directly or via an intermediate transfer medium, to a final substrate. In any case, the visible image of electrostatically or magnetically attracted toner particles, on the final substrate, is not permanent and has to be fixed by causing the toner particles to adhere to each other and the substrate by softening or fusing them followed by cooling. Normally fixing proceeds on more or less porous paper by causing or forcing the softened or fused toner mass to penetrate into the surface irregularities of the paper.

Dry-development toners essentially comprise a thermoplastic binder consisting of a thermoplastic resin or mixture of resins (ref. e.g. U.S. Pat. No. 4,271,249) including colouring matter, e.g. carbon black or finely dispersed dye pigments or soluble dyes. The triboelectrically chargeability is defined by said substances and may, optionally, be modified with a charge controlling agent.

The toner image fixed to a substrate is vulnerable and especially full colour images or black and white images wherein the tonal range is extended by the use of toner particles comprising different amounts of black pigment, are easily cracked upon bending of the substrate bearing the image. This susceptibility to cracking of these images is due to the fact that in such images various layers of fused toner particles are superimposed and that such a relatively thick layer of fused toner particles is quite brittle. The number of superimposed toner layers depends on the colour hue or to the grey density that has to be reproduced. It has been disclosed to apply a layer of colourless toner particles on top of the four colour toner image to protect the image and at the same time equalize the gloss of the image. Typical examples of such layers and different ways to apply such a layer are disclosed in, e.g., EP-A 629 921, EP-A 486 235, U.S. Pat. No. 5,234,783, U.S. Pat. No. 4,828,950, EP-A 554 981, WO 93/07541 and Xerox Research Disclosure Journal, Vol.16, N° 1, p. 69 (January/February 1991). When such a top layer is applied to the toner image, the amount of superimposed toner layers increases and the susceptibility to cracking becomes even greater.

It has been disclosed, in Xerox Disclosure Journal, vol. 16, no 5, Sep. 1, 1991 to apply a thin coating of a plasticizer film on the surface of colour prints and transparencies after the fusing of the toner particles to a copy sheet. Also in JP-A 60/135974 the use of plasticizers in toner images has been disclosed.

The teachings of the prior art disclosures do also in thick toner layers diminish the brittleness, but it appears that the brittleness frequently re-appears after some time-lapse.

There is thus still need for toner images that do not show that drawback and for a method to make images not showing the drawbacks enumerated above.

OBJECTS AND SUMMARY OF THE INVENTION

It is an object of the invention to provide toner images, fixed on a substrate, that are not cracked when the substrate carrying the toner image is bent even when the images are aged.

It is a further object of this invention to provide toner images, fixed on a substrate and being made by the superposition of a plurality of toner layers, with or without a special top layer of toner particles, that are not cracked when the substrate carrying the toner image is bent even when the images are aged.

It is an other object of the invention to provide a method and an apparatus for producing fixed toner images, with or without a special top layer of toner particles, that are not cracked when the substrate carrying the toner image is bent even when the images are aged.

Further objects and advantages of the invention will become clear from the detailed description of the invention hereinafter.

The objects of the invention are realized by providing a toner image fixed on a substrate wherein said toner image comprises a plurality of different types of fused toner particles and on top of it a non-image wise applied layer containing a plasticiser, said plasticiser being present in an amount between 0.01 g/m$^2$ and 10 g/m$^2$ characterised in that at least one of said different types of toner particles contains a toner resin having reactive groups (A) and said plasticizer carries reactive groups (B) and reactive groups A and B are chosen such that they can react together forming a chemical bond between said fused toner particles and said plasticizer.

Preferably said reactive groups, both A and B, are a member selected from the group consisting of epoxy groups, amino groups, mercapto groups, hydroxyl groups and carboxyl groups.

Preferably said plasticizer is present in an amount between 0.1 g/m$^2$ and 7 g/m$^2$.

In a preferred embodiment said toner image comprises, on top of said plurality of fused different types of toner particles, a fused toner layer as clear finish layer and said plasticizer is present on top of said clear finish layer.

DETAILED DESCRIPTION OF THE INVENTION

Toner images, fixed to a substrate, often comprise a plurality of toner layers superimposed on each other. This is especially so in full colour images were different colours and hues are realized by the superposition of yellow, magenta, cyan and black (YMCK) toners. In such an image, the yellow parts are e.g. made up by one layer of toner particles and the black parts, e.g., by the superposition of four layers of toner particles. In EP-A 768 577 it is disclosed to extend the grey scale (tonal range) in a black and white electrostatographic image fixed to a substrate, by realizing the necessary different shades of grey with the superposition of toner particles comprising different amounts of black pigment. Toner images fixed on a substrate and comprising various toner layers in superposition or comprising image parts made up with toner particles in an amount higher 5 g/m$^2$ of toner, are quite brittle and sensitive to cracking when the substrate carrying the image is bent.

When such an image comprises at its surface a certain amount of plasticizer, the resistance to cracking was greatly enhanced. Hereinafter the wording "plasticizer" is used to encompass both a single plasticizing compound, a mixture of plasticizing compounds, a solution of one or more plasticizing compounds in a solvent, etc.

It showed that the non-image wise application of a layer comprising a plasticizer, on top of a toner image, in an amount of between 0.01 g/m$^2$ and 10 g/m$^2$, largely decreased the brittleness and hence the susceptibility to cracking of the image. An amount lower than 0.01 g/m$^2$ did not provide a decrease of brittleness and an amount higher than 10 g/m$^2$ did change too much the gloss of the image and depending on the nature of plasticizer showed an oily surface and/or a tacky surface. The best results, i.e. the best compromise between brittleness and oily and/or tacky surface of the toner image were reached when the plasticizer was applied on top of the image in an amount of between 0.1 and 7 g/m$^2$.

The superposition of various layers of toner particles in an image, depending on the colour hue or to the grey density that has to be reproduced, entail height differences in said image. This "surface relief" enhances the possibility for mechanical scratches to occur in the image. In order to protect a toner image showing "surface relief" it has been proposed, to apply, mostly non-image wise, a clear layer of clear toner particles (i.e. a clear finish layer) on top of the fused toner layers, forming the image. The word "clear" means herein not giving, in a wavelength range extending from 400 to 700 nm, a visible diffuse density, said visible diffuse density being defined as less than 15% light reduction integrated over that wavelength range. By applying such a layer to the image, it is protected and at the same time the gloss of the image is more or less equalized. A finish layer, applied on top of fused image-forming toner layers, is preferably formed by depositing, on top of the toner particles forming the image, a layer of toner particles having a lower meltviscosity than pigmented toner particles forming the image. This provision entails that the meltviscosity of the clear toner particles forming the clear finish layer is between 50 and 2000 Pas, preferably between 100 and 1000 Pas. All meltviscosities mentioned herein are measured in a RHEOMETRICS dynamic rheometer, RVEM-200 (One Possumtown Road, Piscataway, N.J. 08854 USA). The viscosity measurement is carried out at a sample temperature of 120° C. The sample having a weight of 0.75 g is applied in the measuring gap (about 1.5 mm) between two parallel plates of 20 mm diameter one of which is oscillating about its vertical axis at 100 rad/sec and amplitude of $10^{-3}$ radians. Due to the lower meltviscosity, said toner particles forming the finish layer partially interpenetrate, during the fixing process, easily with the toner particles forming the image. Due to this partial interpenetration an even and uninterrupted finish layer is provided. The clear finish layer can applied in such a way that the surface relief is equalized, therefore it is applied "counter image-wise", such that a thicker fixed clear finish layer is present in the lower thickness areas of the image and a thinner fixed clear finish layer is present in the higher thickness areas of the image.

The application of a finish layer on top of a toner image presents several advantage, e.g. reduction of the scratchability, gloss equalization, etc. However by the application of a finish layer the total number of toner layers on the substrate is increased and thus also the brittleness and the susceptibility to cracking of the image. Therefore the non-imagewise application of a layer comprising a plasticizer is highly beneficial in images comprising a clear finish layer.

The application of a layer comprising a plasticizer on top of a toner image is more advantageous to reduce the brittleness of a toner image than to produce the image with toner particles incorporating plasticizers. The incorporation of plasticizers in the bulk of toner particles tends to lower the Tg of the toner particles (essentially the Tg of the toner resin(s) making up the largest part by weight of the toner particles). The lowering of the Tg entails a lowering of the mechanical strength of the toner particles at room temperature and thus toner particles incorporating a plasticizer will be more prone to toner impactation, agglomeration, etc, by the mechanical force exerted on said particles during development and in the toner addition devices.

The plasticizer can be any compound know in the art as plasticizer for plastic materials. It can also be waxes both natural and synthetic.

Very useful plasticizers, for realizing the objects of the present invention, are both very low viscosity plasticizers and polymeric plasticizers that are liquid at room temperature. When using low viscosity plasticizers (i.e. plasticizers with a viscosity ($\eta$) lower than 50 mPas), it is preferred to use plasticizers with a boiling point higher than 180° C. These low viscosity plasticizers can be used alone or a mixture of low viscosity plasticizers can be used. When using polymeric plasticizers (a single compound or a mixture of polymeric plasticizers), that are liquid at room temperature, it is preferred that these plasticizers have a viscosity at 25° C. between 200 and 20,000 mPas. Typical examples of useful plasticizers are given in table 1. It is possible within the scope of the present invention to use a mixture of low viscosity ($\eta \leqq 50$ mPas) plasticizers and higher viscosity (200 mPas$\leqq\eta\leqq$20,000 mPas) plasticizers. The plasticizers useful in this invention can thus be mixtures having a ratio of low viscosity to high viscosity plasticizer between 100:0 and 0:100.

Preferred plasticizer are compounds that can diffuse in the toner layers after application of the compound. Preferred are plasticizers that can readily diffuse in to the toner layers at room temperature, but also compounds that diffuse under the influence of a higher temperature are very useful in this invention. When using a plasticizer that diffuses in to the toner layers under influence of an elevated temperature it is preferred to apply the plasticizer to the toner layers before heat fixing (both in a non-contact and in hot pressure fixing) the toner layers, e.g. by spraying.

TABLE 1

| Plasticizer | Bp °C. | Viscosity, mPas |
|---|---|---|
| Dimethylphthalate | 284 | <50 |
| Dibutylphthalate | 340 | 16.4 |
| Tributylphosphate | 290 | <50 |
| Butylstearate | 365 | 8.3 |
| Ethyleneglycolbutyletheracetate | 190 | 1.8 |
| Diethyleneglycolethyletheracetate | 218 | 2.8 |
| Diethyleneglycolbutyletheracetate | 238 | 3.2 |
| Aliphatic epoxy resin* | — | 400–900 |
| Bisphenol A epoxy resin** | — | 12,000–14,000 |
| Bisphenol A-Bisphenol F epoxy resin† | — | 6,000–9,000 |

*EPIKOTE 871 trade name of Shell Chemical Co
**EPIKOTE 828 trade name of Shell Chemical Co
†EPIKOTE DX235 trade name of Shell Chemical Co The effect of the plasticizer has to last as long as possible, and therefore it is preferred that the plasticizer does not re-diffuse out of the image after a period of time. Therefore it is preferred in this invention, that at least one of said different types of toner particles comprises a toner resin containing reactive groups (A) and said plasticizer comprises reactive groups (B) and reactive groups A and B are chosen such that they can react together forming a chemical bond between said fused toner particles and said plasticizer.

When using a clear finish layer, formed by the deposition an fusing of clear toner particles, said clear toner particles forming said finish layer comprise preferably a toner resin containing reactive groups (A) and said plasticizer comprises reactive groups (B) and reactive groups A and B are chosen such that they can react together forming a chemical bond between said fused toner particles and said plasticizer.

Said reactive groups, both A and B, are preferably members selected from the group consisting of epoxy groups, amino groups, mercapto groups, hydroxyl groups and carboxyl groups.

Resins, for use as toner in toner particles according to the present invention, comprising reactive groups A can be homopolymers as well as copolymers. Typical examples are e.g. polymers (polycondensation polymers or addition polymers) having an acid or hydroxyl value $\geqq$2.5 mg KOH/g. Preferably said polycondensation polymers are polyesters and said addition polymers comprise moieties carrying carboxyl groups (e.g. addition polymers comprising acrylic acid moieties). Typical examples of very useful polymers for toner resins used in toner particles according to this invention are tabulated in table 2. Of these resins the glass transition temperature Tg in ° C. is given together with their number-average molecular weight (Mn) and weight-average molecular weight (Mw). The mentioned Mn and Mw values have to be multiplied by $10^3$. The resins containing free carboxylic acid groups and or hydroxyl groups are characterized by their total acid value (AV) or Hydroxyl value (HV) both expressed in mg KOH per g resin.

Other useful polymers, comprising reactive groups A and useful in the present invention are epoxy resins (linear adducts of bisphenol compounds and epichlorhydrin as described e.g. by D. H. Solomon in the book "The Chemistry of Organic Film Formers"—John Wiley & Sons, Inc, New York (1967) p. 180–181) e.g. EPIKOTE 1004 (EPIKOTE is a registered trade mark of the Shell Chemical Co.), polyamides, copolymers of polyester and polyamides, etc.

The plasticizer comprising reactive groups B, can be a monomeric plasticizer (e.g. an epoxy stearate, an epoxy hydrophathalate, hydrophathalates, hydroisophthalates, etc) or a polymeric plasticizer (e.g. liquid epoxy resins as mentioned in table 1). When a liquid polymeric plasticiser is used, it is preferred that this plasticizer has a viscosity at 25° C. between 200 and 20,000 mPas.

In a preferred embodiment of the invention, the plasticizer is a liquid epoxy resin and the toner particles comprise a toner resin wherein at least 25% by weight of a polyester, having an acid or hydroxyl value $\geqq$2.5 mg KOH/g, is present.

By the chemical binding of the plasticizer to the surface of the image, the decrease of the susceptibility of the image to cracking, due to the presence of the plasticizer, lasted for at least for 60 days.

TABLE 2

| Nr | Chemical structure | AV | HV | Tg | Mn | Mw |
|---|---|---|---|---|---|---|
| P1 | Polyester resin of terephthalic acid, ethyleneglycol and DIANOL 22 | 3 | 31.1 | 62 | 3.6 | 10 |
| P2 | Polyester resin of fumaric acid and DIANOL 33 (ATLAC T500, trade name) | 17 | 5.2 | 55 | 4.4 | 12 |
| P3 | Polyester resin of terephthalic acid 40 mol %), isophthalic acid (60 mol %) and DIANOL 22 (40 mol %) and ethyleneglycol (60 mol %) | 18 | 20.9 | 60 | 4 | 18 |
| S1 | Copoly(styrene-butylacrylate-butylmethacrylate-sterylmethacrylate-methacrylic acid) (65/5/21/5/4) | 12 | 0 | 58 | 6 | 108 |
| S2 | Copoly(styrene-butylmethacrylate-acrylic acid (80/15/5) | 5 | 0 | 63 | 5.5 | 180 |
| P4 | Polyester resin of DIANOL 33/DIANOL 22, terephthalic acid and trimellitic acid | 30 | 50 | 65 | 2.0 | 14 |
| S3 | Co(Styrene/n-butylmethacrylate), diCOOH terminated (65/35) | 15 | 0 | 48 | 2.1 | 10 |

DIANOL 22 is a trade name of AKZO CHEMIE of the Netherlands for bis-ethoxylated 2,2-bis(4-hydroxyphenyl)propane.
DIANOL 33 is a trade name of AKZO CHEMIE of the Netherlands for bis-propoxylated 2,2-bis(4-hydroxyphenyl)propane.

The plasticizer can be applied to the surface of the toner images either in pure form or from a solution or dispersion in an organic solvent or in water. The application in pure form or from a solution or dispersion in water is preferred.

The invention includes also a method for producing toner images on a substrate comprising, in consecutive order, the steps of:

i) applying, image wise, a plurality of layers of toner particles on a substrate forming said toner image,
ii) fixing said toner particles to said substrate, forming an image, and
iii) applying to said image a layer of a plasticizer in an amount between 0.01 g/m2 and 10 g/m2.

The invention also encompasses a method for producing a toner image on a substrate comprising in the order given the steps of:
i) applying, image wise, a plurality of different toner particles on a substrate forming a toner image,
ii) non-imagewise applying to said image a plasticizer, so that said plasticizer is present in amount between 0.01 g/m2 and 10 g/m2 and
iii) fixing said toner particles to said substrate, forming a fused image.

The invention also encompasses a method for producing a toner image on a substrate comprising, in any order, the steps of:
i) applying, image wise, a plurality of different toner particles, at least one of said different types of toner particles containing a toner resin having a reactive groups A, on a substrate forming a toner image,
ii) non-imagewise applying to said image a plasticizer carrying a reactive group B,
iii) reacting said reactive group A with said reactive group B, forming a chemical bond between said fused toner particles and said plasticizer and
iv) fixing said toner image on said substrate and the method as given above, wherein steps i) to iv) are executed in the order given.

In a further embodiment of this method, between the step of the image wise application of said plurality of layers of toner particles on a substrate forming a toner image (step i) and the step of fixing said toner particles to said substrate (step ii) a layer of clear toner particles is applied over the image.

The plasticizer can also be applied on toner images, covered or not with a layer of clear toner particles, before fixing said toner particles and said toner particles are fixed after application of said plasticizer.

The fixing step in the method described above can beneficially comprise a non-contact fusing step.

The methods, outlined above, are especially suited for the production of full colour images and black and white images wherein the different shades of grey are realized by the superposition of toner particles comprising different amounts of black pigment.

The invention also includes an apparatus for producing toner images comprising, in consecutive order:
i) means for image wise depositing a plurality of layers of different types of toner particles on a substrate,
ii) means for fixing said toner image to said substrate and
iii) means for applying on said toner image a plasticizer in an amount between 0.01 g/m2 and 10 g/m2 said plasticizer.

An apparatus according to the present invention can also comprise, between said means for image wise depositing a plurality of layers of different types of toner particles on a substrate and means for fixing said toner image, means for applying a layer of clear toner particles, covering the previously applied layers.

Also an apparatus wherein said means for applying said plasticizer precede said means for fixing said toner image, is within the scope of the present invention. An apparatus according to this invention and described immediately above, comprises beneficially means for non-contact fusing said toner particles.

Said means for applying said plasticizer can be rollers, wicks, sprays, etc. When said means for applying plasticizer are rollers, it may be split rollers, e.g. when 10 g/m$^2$ of plasticizer has to be applied, there may be provided four application rollers, the first two applying together 7.5 g/m$^2$ of plasticizer and the following rollers applying the remaining 2.5 g/m$^2$. Preferred means for applying said plasticizers are supply rollers with a surface in NOMEX-felt (NOMEX is a trade name of Du Pont de Nemours, Wilmington, US) as described in article titled "Innovative Release Agent Delivery Systems" by R. Bucher et al. in The proceedings of IS&T's Eleventh International Congress on Advances in Non-Impact Printing Technologies, page 219–222. This congress was held in Hilton Head, from 29.10.95 to 03.11.95. The proceedings are published by IS&T, Springfield, US 1995. The plasticizers call be delivered to the image directly by supply rollers as described above, or over an intermediate roller, which distributes the oil even more evenly over the image.

In order to control the gloss in an image treated with a plasticizer according to the present invention and fixed in a non-contact fusing process, it may be beneficial to add post-treatment of the fixed image (i.e. the fused toner particles), with a pressure roller in order to further uniformize the image. The pressure roller exerts preferably a pressure, per linear nip-length, on the fixed image of between 100 N/m and 500 N/m, and the post-treatment proceeds for a time preferably between 30 and 150 msec. There are, according to the present invention, two modes of operating said post-treatment. Said two modes differ in the temperature of said post-treatment. In a first mode the almost cold, having been allowed to cool after leaving the non-contact fusing station, fused image is passed through rollers said rollers having a temperature between 20° C. below and 20° C. above the softening temperature of the toner resin, which means in most cases a temperature of around 120° C. In a second mode of operation, the fused image is directly, without allowing it to cool, passed from the fusing station through a rollers, where essentially no additional heat is added to the fixed image, but where the temperature of the post-treatment rollers is kept between 5° C. below and 15° C. above the Tg of the toner resin. Optionally, when necessary for good abhesivity between the fused image and the post-treatment rollers, it is possible to bring releasing agents, e.g. silicon oil, fluid waxes, etc, on the surface of the post-treatment rollers.

A toner image, according to this invention and comprising a plasticizer on top of it, can still be susceptible to scratches. Herein the terms "scratchability" and "scratches" refer both to mechanically scratches such that the toner particles are detached from or smeared over the substrate, and to scratches that are only visible under some angles of illumination.

It may therefore be beneficial to apply not only a plasticizer to a toner image according to the present invention, but also an abhesive compound as described in European Application 96201373.6, filed on May 21, 1996, that is incorporated herein by reference. Such an abhesive compound is preferably present in an amount between 3.0 mg/m$^2$ and 300 mg/m$^2$ and has a viscosity at 25° C. between 50 and 50,000 mPas. Most preferably said abhesive compound is a silicone oil.

The present invention can be practised on toner images that are formed with any electrographic or magnetographic imaging method and with any type of toner particles known in the art. The toner particles can be magnetic or non-magnetic. The developer used to form the image can be mono-component magnetic developer, a non-magnetic mono-component developer, a multi-component developer comprising non-magnetic toner particles and magnetic carrier particles.

The toner particles, used to form a toner image according to the present invention can comprise any known toner resin or mixtures thereof. The toner resin can be a polycondensation polymer or a mixture of different polycondensation polymers as well as an addition polymer or a mixture of addition polymers. Also mixtures of polycondensation polymers and addition polymers are suitable as toner resin for toner particles according to the present invention. When polycondensation polymers are used, the use of polyesters is preferred. Polyester resins suitable for use in toner particles according to the present invention are selected e.g. from the group of linear polycondensation products of (i) di-functional organic acids, e.g. maleic acid, fumaric acid, terephthalic acid and isophthalic acid and (ii) di-functional alcohols (diol) such as ethylene glycol, triethylene glycol, an aromatic dihydroxy compound, preferably a bisphenol such as 2,2-bis(4-hydroxyphenyl)-propane called "Bisphenol A" or an alkoxylated bisphenol, e.g. propoxylated bisphenol examples of which are given in U.S. Pat. No. 4,331,755. For the preparation of suitable polyester resins reference is made to GB-P 1,373,220. When addition polymers are used, it is preferred to use styrene/acrylic resins. Preferred styrene-acrylic resins have a relatively high (more than 70 mol %) styrene content, and are more particularly copolymers of styrene-acrylic resins or styrene-methacrylic resins, e.g. copoly(styrene/n-butylmethacrylate) or copoly(styrene/2-ethyl-hexylacrylate). Also mixtures of polycondensation resins, or mixtures of addition polymers or mixtures of polycondensation polymers and addition polymers can be useful in the preparation of toner particles according to the present invention. Very useful mixtures of polymers for use as toner resin according to the present invention have been disclosed in EP-A 656 129. Toner particles comprising mixtures of polymers as toner resin are preferably toner particles comprising a toner resin, wherein:

(i) said toner resin includes a mixture of two polymers (A and B), said polymers A and B being chosen such that an extruded slab with thickness 250 $\mu$m of a 50:50 mixture of both has a transmission density ($D_M$) being between 0.10 and 1.00 higher than the sum of half the transmission density of a 250 $\mu$m extruded slab of polymer A alone ($D_A$) and half the transmission density of a 250 $\mu$m extruded slab of polymer B alone ($D_B$), (ii) said polymer A being a polyester and said polymer B being a polyester or a styrene-acrylic copolymer, said styrene-acrylic copolymer having a styrene content of more than 70 mol % and a weight average molecular weight ($M_w$) such that $7{,}000<M_w<50{,}000$, (iii) said polymers A and B, included in said toner resin, are mixed in a weight ratio 5:1 to 1:5 and (iv) said mixture of said two polymers A and B makes up at least 25% by weight of said toner resin.

Typical useful resins for being used as mixture in the toner resin comprised in toner particles useful in the present invention are tabulated in table 3.

TABLE 3

| Polymer | Tg °C. | Melt viscosity Pas | $M_w$ | $M_n$ |
|---|---|---|---|---|
| Polyester P5 | 65 | 550 | 11,500 | 3,700 |
| Polyester P6 | 69 | 1,600 | 25,500 | 7,100 |

TABLE 3-continued

| Polymer | Tg °C. | Melt viscosity Pas | $M_w$ | $M_n$ |
|---|---|---|---|---|
| Styr/acryl S4 | 67 | 1,700 | 33,000 | 13,000 |
| Styr/acryl S5 | 68 | 285 | 6,500 | 2,000 |
| Styr/acryl S6 | 78 | 169 | 19,000 | 7,000 |
| Styr/acryl S7 | 79 | 291 | 24,000 | 9,000 |
| Styr/acryl S8 | 79.5 | 698 | 36,000 | 13,500 |
| Styr/acryl S9 | 79 | 2252 | 60,500 | 23,000 |

Polyester P5 is an aromatic polyester resin derived from terephthalic acid (100 mol %) as aromatic diacid and a mixture of DIANOL 33 (50 mol %) and ethylene glycol (50 mol %) as diols. Polyester P6 is an aromatic polyester resin derived from terephthalic acid (64 mol %), isophthalic acid (36 mol %) as aromatic di-acids and ethylene glycol (100 mol %). Styr/acryl S4 is a copolymer of styrene and methyl acrylate in a 65/35 molar ratio.

Styr/acryl S5 is a terpolymer of styrene, methyl acrylate and dimethylaminoethyl methacrylate in a 87/3/10 molar ratio. Styr/acryl S6, S7, S8 and S9 are a copolymer of styrene and methyl acrylate in a 80/20 molar ratio, only differing in molecular weight.

The toner particles can comprise any normal toner ingredient e.g. charge control agents, pigments both coloured and black, dyes, release agents, resistivity regulating agents, anorganic fillers, etc. A description a charge control agents, pigments and other additives useful in toner particles, to be used in a toner composition according to the present invention, can be found in e.g. EP-A 601 235.

EXAMPLES

1. Preparation of the Toner Particles and the Developers

Yellow Toner (Y)

49 parts of polyester P2 (acid value AV of 17 mg KOH/g)of Table 2 and 49 parts of polyester P3 ( AV of 18 mg KOH/g) of Table 2 were melt-blended for 30 minutes at 110° C. in a laboratory kneader with 2 parts of SICOECHTGELB D 1355 DD (Colour Index PY 13, trade name of BASF AG, Germany).

After cooling the solidified mass was pulverized and milled using an ALPINE Fliessbettgegenstrahlmühle type 100AFG (tradename) and further classified using an ALPINE multiplex zig-zag classifier type 100MZR (tradename). The average particle size of the separated toner was measured by Coulter Counter model Multisizer (tradename) was found to be 8.0 $\mu$m by volume.

To improve the flowability of the toner mass the toner particles were mixed with 0.5% of hydrophobic colloidal silica particles (BET-value 130 $m^2/g$).

Magenta Toner (M)

The preparation of the Yellow toner was repeated, but instead of 2 parts SICOECHTGELB PY13, 2 parts of PERMANENT CARMIN FFB 02 (Colour Index PR146, tradename of Hoechst AG, Germany) were used.

Cyan Toner (C)

The preparation of the Yellow toner was repeated, but instead of 2 parts SICOECHTGELB PY13, 2 parts of HELIOGEN BLAU D7072DD (Colour Index PB15:3, trade name of BASF AG, Germany) were used.

Black Toner (K)

The preparation of the Yellow toner was repeated, but instead of 2 parts SICOECHTGELB PY13, 2 parts of CABOT REGAL 400 (carbon black, trade name of the Cabot Corp. High Street 125, Boston, U.S.A.) were used.

The four toners, Y, M, C and K had a meltviscosity at 120° C. of 500 Pas.

Clear Toner 1 (CLT1)

100 parts of polyester P2 (AV 17 g KOH/g) of Table 2 were melt-blended for 30 minutes at 110° C. in a laboratory kneader.

After cooling the solidified mass was pulverized and milled using an ALPINE Fliessbettgegenstrahlmühle type 100AFG (tradename) and further classified using an ALPINE multiplex zig-zag classifier type 100MZR (tradename). The average particle size of the separated toner was measured by Coulter Counter model Multisizer (tradename) was found to be 8.0 μm by volume. The clear toner CLT1 had a meltviscosity at 120° C. of 150 Pas.

To improve the flowability of the toner mass the toner particles were mixed with 0.5% of hydrophobic colloidal silica particles (BET-value 130 $m^2/g$).

Clear Toner 2 (CLT2)

The preparation of clear toner 1 was repeated, but instead of 100 parts of polyester P1 of Table 2, 100 parts of polyester P3 (AV of 18 g KOH/g) of table 2 were used. The clear toner CLT2 had a meltviscosity at 120° C. of 600 Pas.

Clear Toner 3 (CLT3)

The preparation of clear toner 1 was repeated, but instead of 100 parts of polyester P1 of Table 2, 100 parts of an epoxy resin EPIKOTE 1004 (trade mark of the Shell Chemical Co) were used. The clear toner CLT3 had a meltviscosity at 120° C. of 80 Pas.

Developers

Each of the above prepared toners were used to form carrier-toner developers by mixing said mixture of toner particles and colloidal silica in a 4% ratio with silicone-coated Cu—Zn ferrite carrier particles having an average diameter of 55 μm.

2. Printing Examples

Full colour toner images were produced using a commercial CHROMAPRESS (a trade name of Agfa-Gevaert NV, Mortsel, Belgium). The fusing took place with radiant heat. The images were covered with different layers of clear toner particles and with different types and amounts of plasticizer.

The susceptibility of the image to cracking was tested by bending the image over a diameter of 1 cm and observing the cracks at the location of the bending mark. The degree of cracking was given the following quotations:

++ no cracking

+ cracking faintly visible when illuminated under a grazing angle.

0 cracking visible when illuminated under a grazing angle.

– cracking faintly visible under normal incidence of light

–– cracking easily visible under normal incidence of light

The results are reported in table 4.

Printing Example 1 (PE1)

The printed full colour image was covered by the deposition of a layer of clear toner particles of CLT1. Thus the meltviscosity of the clear toner was 150 Pas, whereas the meltviscosity of the coloured toner particles was 500 Pas. On top of the image NO plasticizer was applied.

Printing Example 2 (PE2)

Printing example 1 was repeated, but on top of the clear finish layer plasticizer A, ethyleneglycolbutyletheracetate, with viscosity at 25° C. of 1.8 mPas and boiling point 190° C. was applied in an amount of 0.5 $g/m^2$.

Printing Example 3 (PE3)

Printing Example 2 was repeated, but the plasticizer A was applied in an amount of 2 $g/m^2$.

Printing Example 4 (PE4)

Printing Example 2 was repeated, but the plasticizer A was applied in an amount of 4 $g/m^2$.

Printing Example 5 (PE5)

Printing example 1 was repeated, but on top of the clear finish layer plasticizer B, dibutylphthalate, with viscosity at 25° C. of 16.4 mPas and boiling point 340° C. was applied in an amount of 0.5 $g/m^2$.

Printing Example 6 (PE6)

Printing example 1 was repeated, but on top of the clear finish layer plasticizer C, a bisphenol A/bisphenol F epoxy resin (EPIKOTE DX 235, trade name of Shell Chemical C°) with viscosity at 25° C. between 6,000 and 9,000 mPas was applied in an amount of 0.5 $mg/m^2$.

Printing Example 7 (PE7)

Printing example 6 was repeated, but instead of a clear finish layer of clear toner particles CLT1, a finish layer of clear toner particles CLT2 was applied. Thus the meltviscosity of the clear toner was 600 Pas whereas the meltviscosity of the coloured toner particles was 500 Pas.

Printing Example 8 (PE8)

The printed full colour image was covered by the deposition of a layer of clear toner particles of CLT3. Thus the meltviscosity of the clear toner was 80 Pas whereas the meltviscosity of the coloured toner particles was 500 Pas and the toner resin comprised reactive epoxy groups. On top of this image, plasticizer D, a bisphenol A epoxy resin (EPIKOTE 828, trade name of Shell Chemical C°), having a viscosity at 25° C. between 12,000 and 14,000 mPas, was applied in an amount of 0.5 $g/m^2$.

TABLE 4

| | Plasticizer | | | Finish layer | | | |
|---|---|---|---|---|---|---|---|
| Nr | Am.† | η mPas/bp+ | type | Toner | η Pas | Crac+ | Sur‡ |
| PE1 | 0 | n.a./n.a. | n.a. | CLT1 | 150 | — | OK |
| PE2 | 0.5 | 1.8/190## | A | CLT1 | 150 | – | OK |
| PE3 | 2.0 | 1.8/190## | A | CLT1 | 150 | 0 | OK |
| PE4 | 4.0 | 1.8/190## | A | CLT1 | 150 | + | Acc |
| PE5 | 0.5 | 16.4/340## | B | CLT1 | 150 | + | OK |
| PE6 | 0.5 | $6\ 10^3$–$9\ 10^3$ | C | CLT1 | 150 | ++# | OK |
| PE7 | 0.5 | $6\ 10^3$–$9\ 10^3$ | C | CLT2 | 600 | ++# | Acc |
| PE8 | 0.5 | $12\ 10^3$–$14\ 10^3$ | D | CLT3 | 80 | ++ | Acc |

†amount applied on top of the image ($g/m^2$)

+: Cracking

‡: Surface quality high gloss

: boiling point in °C., for PE7 to PE8 a boiling point is not applicable.

#: effect is not only greater but also lasts much longer than in PE3, PE4, the effect lasts longer than in PE8.

Acc: Acceptable

We claim:

1. A toner image fixed on a substrate comprising a plurality of different types of fused toner particles and on top thereof a layer containing a plasticiser, said plasticiser being present in an amount between 0.01 $g/m^2$ and 10 $g/m^2$ wherein at least one of said different types of toner particles contains a toner resin having at least one reactive group A and said plasticizer carries at least one reactive group B and said reactive groups A and B react together, forming a chemical bond between said fused toner particles and said plasticizer.

2. A toner image according to claim 1, wherein said reactive groups, both A and B, are selected from the group consisting of epoxy groups, amino groups, mercapto groups, hydroxyl groups and carboxyl groups.

3. A toner image according to claim 1, wherein at least one of said different types of toner particles contains a toner resin selected from the group of polycondensation polymers having an acid value ≧2.5 mg KOH/g, addition polymers having an acid value ≧2.5 mg KOH/g, polycondensation polymers having a hydroxyl value ≧2.5 mg KOH/g, addition polymers having a hydroxyl value ≧2.5 mg KOH/g and epoxy resins.

4. A toner image according to claim 1, wherein said plasticiser is a liquid polymeric plasticiser having a viscosity at 25° C. between 200 and 20,000 mPas and contains an epoxy group.

5. A method for producing a toner image on a substrate comprising the steps of:

i) applying, image wise, a plurality of different toner particles, at least one of said different types of toner particles containing a toner resin having a reactive groups A, on a substrate forming a toner image, ii) non-imagewise applying to said image a plasticizer carrying a reactive group B, iii) reacting said reactive group A with said reactive group B, forming a chemical bond between said fused toner particles and said plasticizer and iv) fixing said toner image on said substrate.

* * * * *